US011697042B2

(12) United States Patent
Lund

(10) Patent No.: US 11,697,042 B2
(45) Date of Patent: Jul. 11, 2023

(54) APPARATUS FOR DILUTING AND APPLYING FIREFIGHTING CHEMICAL

(71) Applicant: EarthClean LLC, Minneapolis, MN (US)

(72) Inventor: Terrence L. Lund, Woodbury, MN (US)

(73) Assignee: EARTHCLEAN LLC, Minneapolis, MN (US)

( * ) Notice: Subject to any disclaimer, the term of this patent is extended or adjusted under 35 U.S.C. 154(b) by 264 days.

(21) Appl. No.: 16/868,093

(22) Filed: May 6, 2020

(65) Prior Publication Data

US 2020/0353299 A1 Nov. 12, 2020

Related U.S. Application Data

(60) Provisional application No. 62/846,150, filed on May 10, 2019.

(51) Int. Cl.

| | |
|---|---|
| ***A62C 5/00*** | (2006.01) |
| ***A62C 99/00*** | (2010.01) |
| ***A62D 1/00*** | (2006.01) |
| ***F04D 29/22*** | (2006.01) |
| ***F04D 7/04*** | (2006.01) |

(52) U.S. Cl.

CPC ..... *A62C 5/002* (2013.01); *F04D 7/045* (2013.01); *F04D 29/2288* (2013.01); *A62C 99/009* (2013.01); *A62C 99/0009* (2013.01); *A62D 1/0035* (2013.01)

(58) Field of Classification Search

CPC ... A62C 5/002; A62C 99/0009; A62C 99/009; A62D 1/0035

See application file for complete search history.

(56) References Cited

U.S. PATENT DOCUMENTS

| | | | | |
|---|---|---|---|---|
| 2,543,941 | A * | 3/1951 | Sargent | G05D 11/008 261/DIG. 26 |
| 2,696,266 | A * | 12/1954 | Tuve | A62C 5/02 137/99 |
| 5,240,078 | A * | 8/1993 | Worthington | A62C 27/00 169/14 |
| 6,684,959 | B1 * | 2/2004 | Juidici | A62C 5/02 169/44 |
| 7,163,642 | B2 * | 1/2007 | Hagquist | A62C 5/008 169/44 |
| 7,293,478 | B2 * | 11/2007 | Kudo | A62C 37/50 73/861.79 |
| 7,337,857 | B2 * | 3/2008 | Vonhof | A62C 5/02 169/44 |
| 7,476,346 | B2 | 1/2009 | Hagquist et al. | |
| 8,192,653 | B2 * | 6/2012 | Hagquist | A62D 1/0014 169/44 |
| 8,789,614 | B2 * | 7/2014 | Hosfield | A62C 31/00 169/44 |
| 8,945,437 | B2 | 2/2015 | Hagquist et al. | |
| 8,961,838 | B2 * | 2/2015 | Hagquist | A62D 1/0064 169/44 |
| 9,434,845 | B2 * | 9/2016 | Palaikis | C09D 5/18 |
| 9,616,263 | B2 | 4/2017 | Hagquist et al. | |
| 9,785,676 | B2 * | 10/2017 | Grunick | G06F 16/332 |

(Continued)

*Primary Examiner* — Joseph A Greenlund

(74) *Attorney, Agent, or Firm* — Merchant & Gould P.C.

(57) ABSTRACT

This relates to apparatus that can form dilute aqueous firefighting compositions from an aqueous concentrate.

8 Claims, 11 Drawing Sheets

(56) References Cited

U.S. PATENT DOCUMENTS

| | | | | |
|---|---|---|---|---|
| 2005/0023006 | A1* | 2/2005 | Vonhof | A62C 5/02 169/44 |
| 2005/0177013 | A1* | 8/2005 | Countz | C10G 1/02 422/139 |
| 2006/0076531 | A1* | 4/2006 | Hagguist | A62D 1/0064 252/4 |
| 2010/0065286 | A1* | 3/2010 | Hosfield | A62C 27/00 169/13 |
| 2012/0012344 | A1* | 1/2012 | McLoughlin | A62C 27/00 169/13 |
| 2013/0269957 | A1* | 10/2013 | Hagguist | A62D 1/0042 252/2 |
| 2016/0375284 | A1* | 12/2016 | Doten | A62C 5/033 169/44 |
| 2018/0221697 | A1* | 8/2018 | Shively | A62C 5/02 |
| 2019/0015692 | A1* | 1/2019 | Fieber | A62C 27/00 |
| 2020/0215372 | A1* | 7/2020 | LaVergne | A62D 1/0071 |
| 2020/0353299 | A1* | 11/2020 | Lund | A62D 1/005 |
| 2021/0220686 | A1* | 7/2021 | Lackore, Jr | A62C 99/0036 |
| 2021/0353989 | A1* | 11/2021 | Swayze | A62C 35/68 |

* cited by examiner

APPARATUS FOR DILUTING AND APPLYING FIREFIGHTING CHEMICAL

CROSS-REFERENCE TO RELATED APPLICATIONS

This application claims the benefit of a U.S. Patent Provisional Application Ser. No. 62/846,150, filed May 10, 2019. This application is hereby incorporated by reference in its entirety.

FIELD

The disclosure relates to an apparatus and method to dilute and use firefighting chemicals in a use locus to prevent or extinguish fire.

BACKGROUND

Fire is a continuing danger to life and property worldwide. In the natural environment, forest, brush, and grassland fires cause immense damage each year. This destruction is not only in terms of the dollar value of timber, wildlife and livestock, but the catastrophic effects on erosion, watershed equilibrium and related problems to the natural environment. In urban areas, fire and the damage from large quantities of water used to extinguish a fire is responsible for the destruction of buildings with the loss of billions of dollars annually. In the built environment, fire is a danger to human structures. Most importantly, fire is a major danger to human life.

Over the years man has found numerous methods for combating fires. In general, the use of water, chemicals and other extinguishing materials are well documented. Water treated with a wetting agent has been proven to be more effective on a Class A fire where good water penetration is needed to reach and extinguish the seat of the fire. Currently, there have been efforts in the area of pretreatment with chemical retardants or suppressants. A number of these pretreatments have been developed and used for fighting rural forest fires. For example, antimony oxide and its complexes, borates, carbonates, bicarbonates, ammonium phosphate, ammonium sulfates, and other salts capable of being hydrated, have been demonstrated to have properties as firefighting chemicals. This use , however, has been limited because of expense, toxicity or corrosive properties when used in large quantities.

Another method of fighting fire is the pretreatment of combustible surfaces with flame-retardant materials leading to the creation of intumescent coating materials. Intumescent materials expand with heat, like a vermiculite which expands when exposed to steam. The expanded layer has a heat capacity and can form a layer thickness that protects the original surface from heat and flame. The problem is that an expanded intumescent is also very fragile. This problem was soon realized, and the intumescent needed a protective hard outer coating.

In general, commercial formulations are more expensive than water. Also, the environmental impact of absorbent particles in various gel formulations is substantial. The absorbent particles pose an environmental risk once used to fight a fire, particularly when used on a large scale, such as a forest fire. The cost factor also comes into conflict with applying them in large quantities, as is often required. In combating or preventing forest, brush and grass range fires, a considerable amount of effort has been spent in the search for low cost or waste materials that are both available in quantity and inexpensive.

This led to methods using carbonaceous materials to form a char instead of the materials being consumed by the fire. Many of these materials have some capacity but are not environmentally sensitive, expensive and are difficult to make and use. The use of starch, water soluble polymeric thickeners (suspending agents) in combination with other actives has been described by U.S. Pat. Nos. 7,163, 642, 7,476,346, 8,192,653, 8,945,437, 9,616,263, 8,961,838, 9,785, 676, 9,434.845 (and related patents) are incorporated herein by reference.

Several commercial apparatus are used to form firefighting gels or dispersions. These are complex in design, can produce materials with varying quality and can be subject to failure and interrupted operation and can be difficult to transport.

A substantial need exists for a simple and robust apparatus that can reliably dilute and apply a chemical that can extinguish or prevent fire in a use locus. The apparatus can have the capability to dispense a range of concentrations of dilute chemical. The dilute chemical can be in a form that extinguishes fire but also can form a barrier to fire on as combustible surface to prevent or reduce damage. We have found that these problems can be substantially solved by using the chemical systems in concentrate form, as described below, in a simple dilution application apparatus as disclosed that is designed to blend the concentrates with a dilution liquid at a set rate and apply the dilute dispersion or gel material, once mixed, to the ignition source.

BRIEF DESCRIPTION

We have found a combination of a biodegradable suspension forming composition and diluting/dispenser. The fire suppression biodegradable suspension forming compositions be used to extinguish a fire or prevent a fire by coating a surface and forming a crust after contacting a heat source.

In a first embodiment an apparatus is disclosed that can directly dilute and dispense firefighting chemical to a use locus. This first embodiment can be mounted on a truck or train platform and can use local available sources of environmental water, service water, diluent tank truck water or can use diluent in container(s) of the apparatus.

In a second embodiment an apparatus is disclosed that can dilute and fill a container, transport both concentrate and diluent to a use locus that in turn can direct the firefighting chemical to the use locus if and when it is needed. This second embodiment can be used where a local source of diluent is not available and is required to be carried with concentrate. This embodiment permits dilution if and when needed. In one such mode the chemical can be diluted and dispensed when airborne. If not used either or both diluent and concentrate can be conserved or discarded if needed.

A third embodiment involves a process that uses a diluent source, a concentrate source, and pumps to deliver a useful firefighting chemical in an aqueous form in an airborne delivery.

These three embodiments all use a first pump to direct concentrate into the centrifugal pump that can readily mix and dispense a uniform dispersion. These embodiments do not use the venturi common in commercial equipment to draw concentrate into a diluent stream.

Briefly, the apparatus for the first embodiment contains a three-way conduit mounted in close relation to the final pump. The source of aqueous dilution and the source of chemical concentrate are fluidly and separately connected to the input openings in the conduit. The concentrate source has a volume of about 1 gallon to any arbitrary limit depending on potential and actual fire conditions. The diluent is pumped to the three-way. If the diluent source is a service or environmental water, it is unlimited. If needed a container of diluent has a volume of about 10 to 40,000 or 20 to 5000 gallons. The concentrate is pumped through the three way into the centrifugal pump where the aqueous diluent and concentrate are blended and directed to the use locus. The three-way conduit is simply a conduit structure and contains no Venturi or other internal structure except for the passageways for the inputs and the output. The concentrate pump is adequate to move concentrate into the three way and final pump. The output from the diluent conduit is directed in liquid communication to the centrifugal pump, which can cause the diluent to flow through the three-way conduit and can also draw the pumped concentrate liquid that is introduced into the three-way conduit. The concentrate stream and the diluent stream pass through the three-way conduit into the fluid communication to the pump at a rate set by the pumping rates of the concentrate pump. This can be accomplished or used in two modes. In a first mode the diluent is connected to the three-way. In a second more the three way is simply immersed in the diluent and the diluent is drawn into the three way by the action of the final pump.

Briefly, in the second embodiment, the pump is immersed in the diluent. The concentrate is pumped into the pump. The pump can be operated in one of two modes. First the pump can be run only to mix the concentrate and diluent that is circulated in the container. In as second mode the apparatus can deliver the chemical through the pump action or can simply drop the chemical to deliver diluted chemical to the use locus.

We believe that there is some mixing of the concentrate and the diluent within the three-way conduit and in the fluid communication to the downstream pump. However, the pump acts both to pump diluent through the system and to intimately mix the concentrate and the diluent to form the uniform mixture that is the firefighting compositions of this disclosure. A uniform dispersion is made to prevent or extinguish a fire. The concentrate pump and the downstream pump are both set at a rate such that the downstream pump pumps at a rate substantially greater than the concentrate pump, thus providing a ratio of dilution of the material that is adapted for the desired dilution of the concentrate. The downstream pump is also set at a rate sufficient to cause the fully uniform blended aqueous firefighting chemical to be delivered to the ignition source at a sufficient rate and pressure to create a useful spray that utilize both a distance of application, a spray dispersion and an application rate sufficient to deal with any fire situation. The coating of chemical can prevent fire and the chemical can extinguish active flames.

The final pump is at a rate to both draw flow and to effectively treat the fire.

A useful final pump rate is about 1 to 2000, or 5 to 750 gal-min$^{-1}$.

A useful concentrate pump rate is set to deliver the useful dilution of about 0.01 to 5 wt. % of concentrate in the dilution liquid or 0.05 to 2 wt. % concentrate in the firefighting chemical.

Briefly, in a second embodiment, a portable apparatus contains both concentrate and diluent and dilutes and stores an aqueous firefighting chemical. The apparatus comprises a source of diluent, a source of firefighting concentrate, a container comprising at least 100, often 200 to 4000 or 300 to 2500 gallons, a pump installed and positioned within the container such that the product pump will be immersed in fluid during operation. The dilute chemical is diluted and dispensed by a controller that is configured to fill the container with diluent and to independently initiate the pump. The pump can first blend the concentrate into the diluent and then when needed pump the dilute chemical from the container. In order to operate the apparatus contains a first conduit flowing diluent into the container and a second conduit flowing concentrate into the pump in the container. The apparatus has two modes of operation, in a first mode the pump mixes and circulates concentrate within the volume of diluent in the container; and in a second mode the dilute uniform dispersion of firefighting chemical is pumped from the container. The diluent commonly comprises service water and the concentrate comprise a non-aqueous liquid comprising starch, a thickener, vegetable oil and small molecule hydrocarbon.

In one illustrative embodiment, a fire suppression composition includes starch, a suspending agent, paraffin or olefin, a vegetable oil and a pH control that can be a basic material. These and various other features and advantages will be apparent from a reading of the following detailed description.

Firefighting chemicals must be easily made, cost effective and reliably applied. A substantial need exists for a method and apparatus for blending and applying a fire fighting chemical that can be a suspension or gel to an ignition source.

We have found an apparatus that can form and apply, cost and performance effective dilute aqueous firefighting dispersion or gel compositions. The apparatus, like the chemistry herein, is simple and cost sensitive but is effective in both making the diluted chemicals and in safe uninterrupted operation. The apparatus can make a composition with efficiency and consistency that are particularly useful in dealing with fire supersession. The compositions when diluted with water forming a suspension that includes starch, a suspending agent, a vegetable oil and a $C_{6-20}$ hydrocarbon paraffin or olefin that forms a suspension when combined with water. The suspension composition has substantial heat capacity as a suspension or gel. The starch component can form a crust after contacting a heat source and can absorb heat in the crust form. After crusting-over occurs, continued heating or burning near the compositions causes the crust to tum to a carbonized char. At this point, the suspension composition consists of an outer coat of char, which forms a hard, intumescent coating, and a soft interior of a gelled aqueous composition. This synergist combination of hard shell protecting a soft interior gel, remains in place until all the composition's water has been evaporated. The composition functions as a dual heat sink, maintaining a substrate temperature below around 100° C.

In applying liquid firefighting chemicals to an ignition source some version of a spray-on apparatus for dispersions or gels are typically used. Such sprays can include apparatuses as simple as a direct water spray from a hose and outlet device. Alternatively, several different types of dilute chemicals can be sprayed from a variety of systems that mix and spray aqueous materials onto an ignition source. These devices that mix a stream of chemical concentrate with a dilution liquid are often difficult to operate, often have problems in providing a continuous spray of dilute chemical, can easily clog interrupting the stream or affecting the dilution rate, or can have operating controls that make it difficult for firefighters to deal with the proper settings when under stress during a fire emergency.

In the following description, it is to be understood that other embodiments are contemplated and may be made without departing from the claimed scope or spirit. The following detailed description, therefore, is not to be taken in a limiting sense.

As used in this specification and the appended claims, the singular forms "a", "an", and "the" encompass embodiments having plural referents, unless the content clearly dictates otherwise. As used in this specification and the appended claims, the term "or" is generally employed in its inclusive sense including "and/or" unless the content clearly dictates otherwise.

The term "three-way conduit," we mean a conduit having a first input and a second input with a single output.

The term "diluent" means an aqueous diluent having a viscosity substantially equivalent to that of commonly available groundwater or municipal service water.

The term "concentrate" means a non-aqueous liquid that comprises a starch, a thickener, and a $C_{5-25}$ hydrocarbon component.

The term "chemical" or "fire-fighting chemical" refers to a typically dilute liquid, thickened or gelled aqueous material that is capable of either preventing ignition in an ignition source or extinguishing a fire existing in an ignition source.

The term "source of ignition" or "ignition source" typically refers to any burnable material either in the natural environment or in the built environment. Natural environment includes brush, forests or other such natural vegetation subject to destructive fires. The source of ignition in the built environment typically includes human habitations, farm buildings, out buildings and other such structures made from flammable construction materials typically cellulosic or synthetic organic materials.

Figure 1:
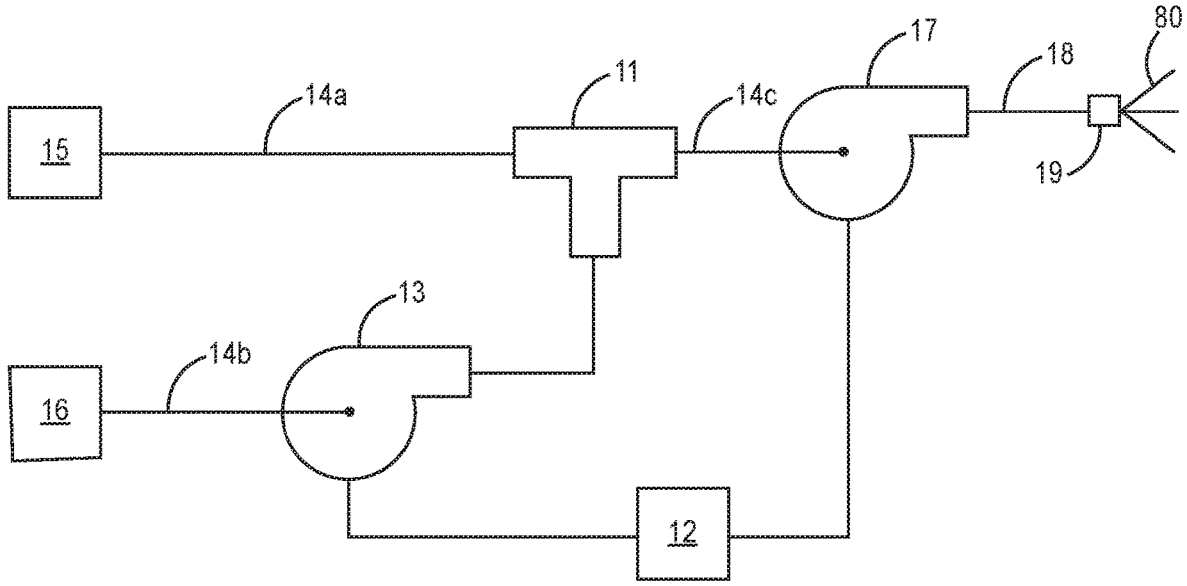
FIG. 1 shows the minimal requirements in an elemental block diagram of the apparatus of the first embodiment of the disclosure.

The figures are not necessarily to scale. Like numbers used in the figures refer to like components. However, it will be understood that the use of a number to refer to a component in each figure is not intended to limit the component in another figure labeled with the same number. In the Figures there are concentrate pump 13 and final pump 17. Pump 13 directs a flow of concentrate and pump 17 blends the dilution and directs diluent to form the fire chemical.

DETAILED DESCRIPTION

In the disclosed apparatus, the diluent, aqueous diluent, and the concentrate are typically delivered to a final pump. The aqueous diluent alternatively can be delivered from a source of ground or municipal service water directly into the apparatus if available. When used from such sources, the diluent is delivered at a common pressure that ranges from about 1 to 100 psi into the fluid connection. When used from such sources, the concentrate is delivered at a common pressure greater than that in the conduit and that ranges from about 50 to 800 psi (5,520 kPa) into the fluid connection. In the case that the diluent is held in a large tank before entry into the fluid connection, the tank can be any size enough to treat the desired target ignition source. Such tanks can range from multi-gallon tanks such as that is seen in firefighting equipment.

Similarly, the concentrate can be delivered from a tank. The concentrate tank can be a lesser volume of concentrate, and since the dilution rate often results in a delivered firefighting chemical that contains from 0.01 to about 5 wt. % of concentrate and diluent, the concentrate tank can be sized appropriately with respect to the known volume of the diluent source. Clearly if the diluent source is municipal or groundwater, the concentrate source can be virtually any size container. The diluent tank can be of a material and design that is simply arbitrarily selected by the user. Commonly firefighting equipment is used as a source of diluent, and such equipment commonly is in the form of a fire tanker truck having a large container ranging from about 500 to 10,000 gallons of a diluent. The diluent tank must be sized and configured such that it can deliver into the fluid connection enough diluent to result in the appropriate concentrate-diluent ratio.

The concentrate tank can be sized and configured such that it contains an appropriate amount of diluent to provide the 0.01 to 5 wt. % percent dilution of the concentrate into the diluent material. The concentrate tank can be designed and configured to deliver the concentrate into the fluid connection at enough rate such that it can be pumped into the three-way conduit in concert with the flow of the diluent. The flow of the diluent and the concentrate must be metered at a rate sufficiently such that the flow of both diluent and concentrate through a connector is maintained at a constant and consistent ratio to form the appropriately diluted firefighting chemical.

The concentrate is directed through a pump by a fluid connection, and the pump outlet is directed into the three-way conduit using fluid connections. The concentrate pump is operated at a rate such that it can overcome any pressure in the three-way conduit derived from the flow of diluent such that the flow of concentrate into the diluent stream remains constant and consistent with respect to the final firefighting chemical concentration needs. If the diluent is simply provided from a tank, the pressure within the three-way conduit will be minimal. However, if it is delivered by a municipal water service or groundwater or other pump system, the conduit will have substantial pressure which must be overcome by the pump rate of the concentrate pump.

The three-way conduit conveys both the diluent and the concentrate at the appropriate dilution ratio through a fluid connection into a pump. The pump is designed and configured to ensure that the combined flow of diluent and concentrate is enough to deal with any fire or other need in the built or natural environment. Both the outlet pump and the concentrate pump are controlled such that the rate of concentrate flowing into the three-way conduit is appropriate for the dilution ratio required, and the outlet pump is controlled such that it provides sufficient firefighting chemical to the ignition source. These pumps can be controlled using a variety of control mechanisms. A combined control system can be used, or separate controls can be used even if housed within the same control structure. The outlet of the outlet pump is then directed through a spray head that can create a spray distribution that is designed and configured to either coat a vulnerable ignition source or to effectively reduce or eliminate a combustion at an involved ignition source.

Both aspects of the dilution dispensing system as disclosed use a very specific pump design to achieve the mixing and dispensing results needed for suppressing or fighting fires in both the built and the natural environment. We have found that to achieve proper use of the concentrate, thorough mixing of the concentrate into the diluent and the delivery of the diluted firefighting chemical to the use locus requires a specific design for the input of the concentrate into the pump and that input cooperates with pump design to achieve both full mixing, uniform concentration and effective output for treating the use locus or extinguishing an active fire.

We have found that the needed pump design involves introducing the concentrate immediately upstream from the centrifugal with a bladed rotating mixer/impeller pump mechanism at a pressure such that the pressure will cause the concentrate to enter the stream of diluent. The pressure of the concentrate and the diluent are adjusted such that approximately 0.01 to 5 wt. % of the concentrate is introduced into the diluent during operation of the pump. As the concentrate enters the stream of diluent just upstream of the pump, the combination of the two streams enters a centrifugal pumping chamber wherein a centrifugal pump mechanism both ensures a uniform dispersion of the concentrate in the diluent and secondarily causes the diluted firefighting chemical to exit the pump at sufficient volume and pressure that it can both prevent or extinguish fires in both the natural and the built environment.

Centrifugal pumps that are useful in such mixing and dispensing are centrifugal pumps that include within the pumping chamber and impeller that is driven by a shaft attached to typically an electric motor with sufficient horsepower to maintain sufficient flow and pressure for the purposes of the disclosed dispenser equipment.

Peristaltic pumps that direct the concentrate into the system for dilution and use provide desirable performance. The concentrate that tends to thicken can plug many pump types. The peristaltic pump does not experience plugging like piston or centrifugal pumps. The peristaltic pump is easily installed in line and always operates smoothly.

Figure 11:
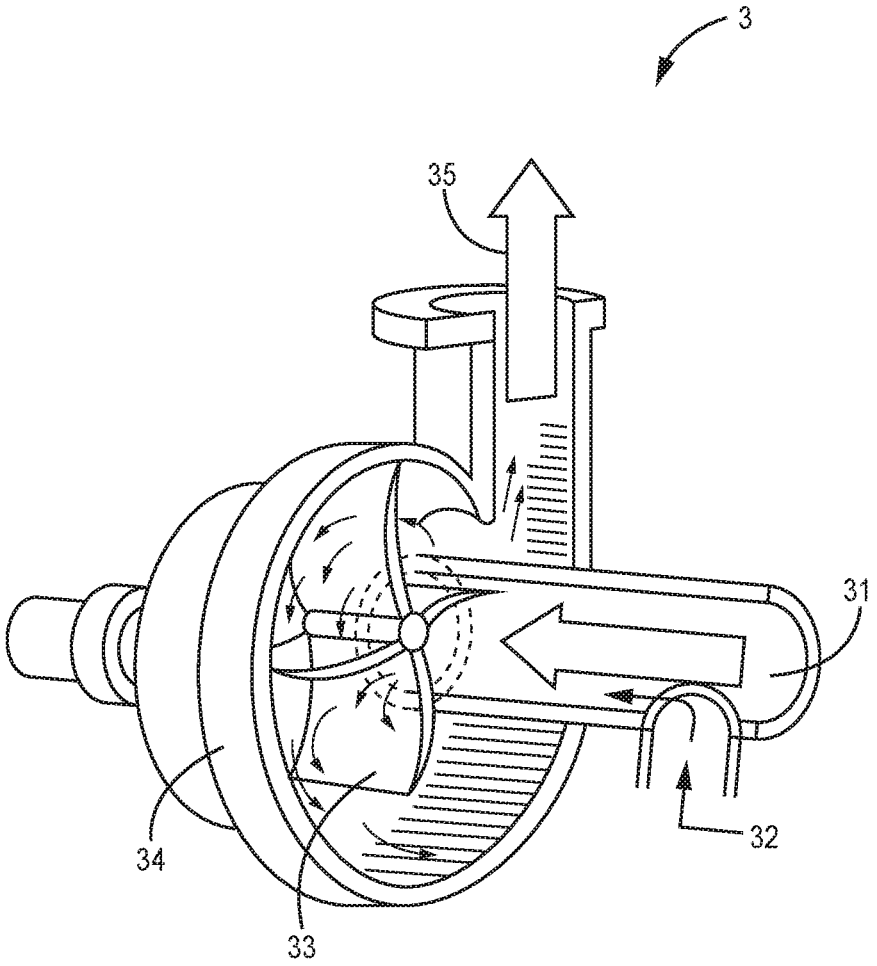
FIG. 11 is a view of the internal working components of one type of centrifugal pump that can successfully dilute and dispense the firefighting concentrate and chemical of the claimed composition.

As can be readily seen in FIG. 11, the conduit for introducing the concentrate into the diluent stream is integrated into or placed as close to the impeller in the pumping chamber as is engineeringly possible to achieve appropriate dilution and dispensing.

The disclosed compositions can be augmentations to water, either from concentrate or dry blends, used to extinguish fires, for example. The concentrate or dry blend is added to a water reservoir and mixed in or allowed to recirculate to form the fire suppression suspension. These compositions use suspending agents, starch, paraffin or olefin and a basic material, added to water to produce a stable, non-settling augmentation to water. The aqueous suspension is easily pumped or sprayed by typical high-pressure pumping equipment or by low-pressure individual back tanks. The suspension composition has a "high yield value," meaning it has an initial resistance to flow under stress but then is shear thinning, and when used, exhibits "vertical cling," meaning it has the ability at rest, to immediately return to a thixotropic gel. The material that does not separate or settle, can be easily sprayed and immediately thickens when it contacts a wall or ceiling surface. This gives the firefighter, for example, the ability, unlike water alone, to build thickness and hold the aqueous gel of the inventive composition on vertical or overhead surfaces. The aqueous gel of the suspension composition's mass and the vertical cling both acts as a heat sink capable of clinging to vertical and overhead surfaces. This clinging to the surfaces causes the overall temperature of the surfaces to remain below the boiling point of water. The heat sink effect does not allow the temperature of the surface coated with the aqueous gel of the composition to exceed about 100 degree Centigrade until all the water in the composition has been evaporated.

To produce this shear thinning effect and then cling, the composition uses a—suspending agent. In many embodiments the composition includes starch, a pseudo-plastic, high yield, suspending agent, paraffin or olefin and a basic material. These materials can be mixed or blended utilizing a mixer to obtain a composition. These compositions quickly form a stable low viscosity suspension when combined with water. In many embodiments, the suspension composition has a pH in the range of 5.0 to 8.0 and the suspension composition clings to a surface positioned in any orientation and forms an exterior intumescent char coating upon fire contact, while retaining an interior aqueous gel composition.

In many embodiments the composition (e.g., liquid or powdered composition) includes a suspending agent, starch, a hydrocarbon such as a small molecule paraffin or olefin, and enough basic material for a useful pH, for environmental. This powdered material is diluted before use in the apparatus.

These compositions can be diluted with water to form an aqueous suspension or gel. In many embodiments the aqueous suspension includes from 0.01 to 5 wt. % of the composition or powdered composition. In some embodiments, the aqueous suspension includes from 0.5 to 1% wt. of the composition or powdered composition. It has been found that the aqueous suspension composition clings to a surface positioned in any orientation and forms an exterior intumescent char coating upon fire contact, while retaining an interior aqueous gel composition. The concentrate can have a viscosity of about 3,000 to 30,000 or 4,000 to 25,000 cP; the diluent can have a viscosity of near water. the dilute firefighting gel or suspension can have a viscosity at about 2 to less than 3000 or 10 to 2000 cP, all at 25° C.

There are many types of suspending agents or rheology modifiers that can be used successfully in the inventive composition. Two of the major groups of such suspending agents are organic agents and clay. CARBOPOLS™ additives are generally high molecular weight homo- and copolymers of acrylic acid often cross linked with a poly alkenyl polyether. Other polymers and synthetic clays are suitable and may be used in combination to develop special suspending agent characteristics. In using a combination of these suspending agents, synergism is found, for example, between laponites and CARBOPOLS™, where a blend offers improved characteristics for the composition.

The CARBOPOLS™, are particularly effective materials an example is CARBOPOLS™ EZ-3, a hydrophobically modified cross-linked polyacrylate powder. The polymer is self-wetting and requires low agitation for dispersion. The convenience of low agitation is very evident in the very short wetting out time needed, when making a concentrate. CARBOPOLS™ EZ-3 is commercially available from Noveon, Inc., Cleveland, Ohio 44141. These materials hold solid particles in suspension without allowing the solids to settle. These materials have a shear thinning rheology so they can be pumped or sprayed onto a surface without the loss of cling. The CARBOPOLS™ EZ-3 is the more efficient of suspending agents tested and the Laponite RDS one of the fastest to build in viscosity, after shear thinning. The laponites are especially sensitive to electrolytes or the typical salts in water. Many suspending agents need to be fully dispersed and hydrated in water to achieve the best performance characteristics. The suspension composition improves the overall efficiency of putting fire out with water. Other suitable pseudo-plastic, high yield, suspending agents include modified guar and xanthan gums, casein, alginates, modified cellulose, including methyl cellulose, hydroxyethyl cellulose, hydroxypropyl cellulose and carbo-methyl cellulose, gum tragacanthin used individually or in combination.

The suspension compositions have a high yield value with a "shear thinning capacity" which means, the suspension composition becomes thin when pumped and instantly thixotropic or sag resistant, at rest. Thus, after being pumped and sprayed, the suspension composition is capable of clinging to a vertical or overhead surface.

Any starch can be used in the suspension compositions. Examples of starches include corn, wheat, potato, tapioca, barley, arrowroot, rice or any combination of starches. Dry starch contains about 12% water and has a particle size in a range from 1 to 50 microns. When soaked in water, the starch associates and holds up to 18% water and the particle size increases to 40 microns. As the starch/water mixture is heated, in this case by a fire, the starch forms a gel or association with all the surrounding water starting around 70 degrees Centigrade. Thus, when the composition is heated, either from the substrate or the air side, the starch absorbs more water at the interface and becomes thicker. On the substrate side, the composition first rides on its own vapor and, as it cools, forms its own film on the substrate surface. On the air side, where evaporation largely occurs, the composition first thickens and then crusts over and eventually is converted to a carbonized char.

The char formed is a hard, intumescent coating, which slows the evaporation of water from the composition. The composition's own film and char act as a vessel to contain the soft-gelled composition, which now acts as a heat sink to cool the backside of the intumescent char. This synergism between the intumescent hard coating and the composition's aqueous gel helps optimize a very limited amount of water. The char/gel coating further reduces the available combustible material to the fire and reduces the smoke emission. There are no dangerous chemical reactions caused by the application of the inventive, environmentally friendly composition and its byproducts are neither corrosive nor toxic.

Hydrophobic agglomerating material can be added to the composition. It has been found that the hydrophobic agglomerating material improves the material properties such as product viscosity and uniformity as compared to compositions that do not include the material. While not wishing to be bound to any theory, it is believed that the hydrophobic agglomerating material improves the speed at which the aqueous gel or aqueous suspension is formed, blending and reduces final viscosity. In many fire suppression applications, quick formation of the low viscosity aqueous gel or aqueous suspension is important. In many embodiments the hydrophobic agglomerating material includes liquid hydrocarbon is the form of a paraffin or olefin. Paraffin is the common name for branched and linear alkane hydrocarbons with the general formula $CnH_{2n+2}$. Liquid paraffin generally with less than 20 carbon atoms. In many embodiments the paraffin has from 6 to 18 carbon atoms and is linear or has from 8 to 16 carbon atoms and is linear. Olefin is the common name for alkene hydrocarbons with the general formula $CnH_2n$ where the hydrocarbon is unsaturated. In many embodiments the olefin has less than 20, from 5 to 20, 6 to 18, 8 to 16 carbon atoms and is linear.

Typical vegetable oils can be used.

Commercially available paraffins and olefins include BIO-BASE™ 100LF (linear internal olefin with a carbon chain length between $C_{15-18}$), BIO-BASE™ 300 (linear paraffin with a carbon chain length between $C_{11-14}$), BIO-BASE™ 200 (linear alpha olefin with a carbon chain length between $C_{16-18}$), BIO-BASE™ 220 (linear alpha olefin with a carbon chain length between $C_{14-16}$), BIO-BASE™ 250 (linear alpha olefin with a carbon chain length between $C_{14-18}$), BIO-BASE™ 360 (blend of iso-paraffins and linear paraffins with a carbon chain length between $C_{15-16}$), all are available from Shrieve Chemical Products Company (Woodlands, Tex.). The presence of the hydrophobic agglomerating material improves the viscosity, performance of the composition, reduces the dusting of the composition and reduces the foam generation when the dry composition is combined with water to form the preferred aqueous gel suspension.

The compositions can include a pH adjusting neutralizer or basic material. In many embodiments the basic material is any material capable of increasing pH when added to an aqueous material (e.g., forming the aqueous suspension). In many embodiments the basic material includes caustic soda or sodium hydroxide. In many embodiments, starch at least partially encapsulates particles of the neutralizer or basic material (e.g., caustic soda particles).

The disclosure may be more completely understood in consideration of the following detailed description of various embodiments of the disclosure in connection with the accompanying drawings. The implementations described above, and other implementations are within the scope of the following claims. One skilled in the art will appreciate that the claimed embodiments can be practiced with other than those disclosed. The disclosed embodiments present illustrations and are not limiting. The scope of claims is limited only by the claims that issue.

A fire suppression composition comprising a concentrate free of liquid water, the concentrate adapted to dilution with water to form a fire suppression suspension, the concentrate comprising a dispersion comprising at least 20 wt. % of a starch; at least 20 wt. % of a pseudo plastic, high yield, sodium polyacrylate suspending agent; vegetable oil and a $C_{6-18}$ olefin; and 0.0 to 5 wt. % clay; wherein the composition and its byproducts are neither corrosive nor toxic.

A non-aqueous liquid concentrate comprising the concentrate adapted to dilution with water to form a fire suppression suspension, the concentrate comprising a dispersion comprising: starch; an acrylic acid homopolymer salt; vegetable oil and a small molecule hydrocarbon such as a $C_{6-18}$ olefin; and 0.0 to 5 wt. % clay; wherein, the non-aqueous liquid concentrate forms an aqueous dispersion when added to water and is capable of clinging to a surface.

A non-aqueous liquid concentrate comprising the concentrate adapted to dilution with water to form a fire suppression suspension, the concentrate comprising a dispersion comprising: starch; an acrylic acid homopolymer salt; vegetable oil and a $C_{6-18}$ olefin; and 0 to 5 wt. % clay; wherein, the non-aqueous liquid concentrate forms an aqueous dispersion when added to water and is capable of clinging to a surface.

A powder composition comprising a powdered concentrate free of liquid water, the concentrate adapted for dilution with water to form a fire suppression suspension, the composition comprising; at least 20 wt. % starch; at least 20 wt. % of a pseudo plastic, high yield, acrylic acid homo polymer suspending agent; vegetable oil and a $C_{6-18}$ olefin; and 0.0 to 5 wt. % clay; wherein, the powder composition forms an aqueous dispersion when added to water and is capable of clinging to a surface, and the composition and its byproducts are environmentally friendly and neither corrosive nor toxic.

These compositions can contain in a composition at least 50 wt. % starch; up to 40 wt. % acrylic acid homopolymer salt; 0.5-5 wt. % vegetable oil; 0.05-6 wt. % $C_{6-18}$ olefin and 0.5-7 wt. % preservative comprising propyl paraben.

DETAILED DESCRIPTIONS OF THE FIGURES

FIG. 1 shows an apparatus that can dilute the concentrate material with a diluent, mix the concentrate in the diluent and then deliver the mixed uniform material to a use locus for the purpose of extinguishing or preventing fire. In FIG. 1 there are concentrate tank 16 and diluent source or tank 15. Concentrate 16 tank is fluidly connected to concentrate pump 13 through conduit 14*b*. Diluent is fluidly connected to a three-way conduit 11 through conduit 14*a*. The concentrate from tank 16 is pumped by pump 13 into the three-way conduit 11. The three-way conduit combines the flow of concentrate and diluent from their respective sources and passes the combined flow through conduit 14*c* into final pump 17. Within pump 17, the diluent and concentrate are uniformly mixed and at enough pressure is directed through a conduit 18 into pump head 19 wherein it is sprayed onto the use locus for extinguishing or preventing fires. The operation of pump 13 and pump 17 are controlled by control 12.

In FIG. 1, control 12 has multiple functions. First, the control will establish the rate at which the concentrate is directed into the three-way valve in order to control the dilution factor, resulting in a dilution of the concentrate in the diluent that can range from about 0.01 to 5 wt. % of the concentrate into the diluent, the wt. % based entirely on the total volume of the diluted chemical. The controller 12 also controls the operation of pumps 13 and 17. The pumps can be operated simultaneously, such that when the pumps are activated, they simultaneously begin in unison or they can be operated serially. Under certain circumstances, it may be helpful to pump the concentrate into the three-way valve 11 and to pump 17 before initiating the pumping of the combined flow.

Figure 10:
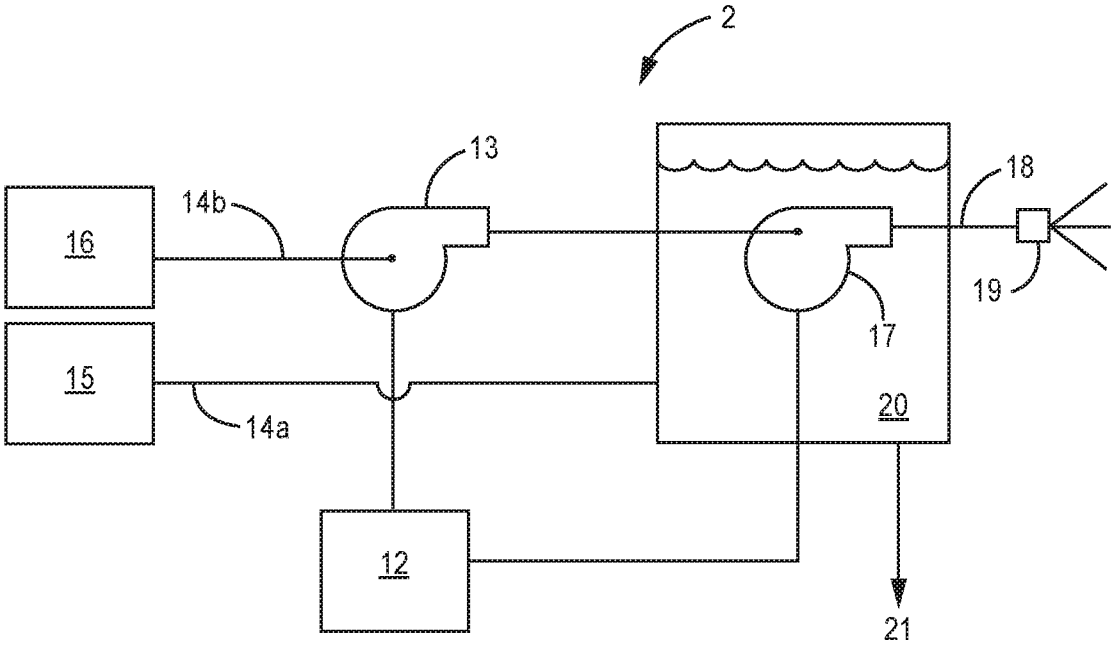
FIG. 10 shows the minimal requirements in an elemental block diagram of the apparatus of the second embodiment of the disclosure.

FIG. 10 shows the configuration of a second embodiment of the dilution apparatus of the invention. In this mode of operation, concentrate is held in a container 16 which is then fluidly connected to concentrate pump 13 through conduit 14*b*. Diluent is obtained from diluent source 15 or container 15. The concentrate from container 16 is directed by pump 13 into final pump 17 where it is then mixed or diluted or sprayed from or otherwise delivered from the apparatus. In operation pump 17 is immersed in tank 20 that, when used, is filled with diluent, typically water. In operation, concentrate 16 is directed into pump 13 and in turn is pumped into pump 17, immersed in diluent 20. With the operation of pump 17, the diluent is drawn into pump 17 together with diluent from tank 20. In this mode no fluid connection is necessary between the tank 20 and pump 17 since the intake of the pump is directly immersed into the volume of diluent without connecting conduits. However, in certain circumstances, it may be useful to extend a short conduit to ensure that all diluent is removed from the tank depending on the placement of the pump. If the pump is placed at or near the top of the tank, then as the pump is operated, and the tank is exhausted, a short conduit is needed to access the total volume of diluent by removing the diluent from the bottom of the tank 20.

The apparatus can be operated in different modes. In mode one, the tank 20 is filled with water from a diluent source or separate container 15. Alternatively, the tank 20 can be filled from water available at the use locus from a fire hydrant or natural water source such as a lake or river. Both pumps 13 and 17 are connected to a controller system 12 that it is capable of setting the dilution rate of the concentrate in the diluent such that the diluted chemical has a concentration of 0.01 to 5 wt. % of concentrate in the diluent, based on the total weight of the concentrate and also can operate pumps 13 and 17 either simultaneously or in serial operation.

There is a separate use mode for the apparatus of FIG. 10 when used in an airborne firefighting system. The concentrate container 16 and the tank 20 is typically mounted in or on the airframe and the source of diluent is a natural source such as a lake or river. In operation, the aircraft either lands on the water or skims the water surface in order to draw enough diluent from the natural source into the water tank 20. The water source can be pumped from the natural source or the speed of the aircraft skimming the water can force enough water into the pump while the aircraft is in motion.

FIG. 11 is a view of the internal working components of one type of centrifugal pump 3 that embodies pump 17 in FIGS. 1 and 10. Pump 17 can successfully dilute and dispense the firefighting concentrate and chemical of the claimed composition.

In FIG. 11 is shown pump 3 comprising a diluent intake 31, a concentrate intake 32, the centrifugal bladed impeller 33 contained within a housing 34. As the impeller rotates at sufficient RPM, the diluent and concentrate are pulled into the pumping chamber and then are mixed and are immediately dispensed through outlet 35 which permits the flow of diluted chemical at sufficient pressure and flow rate such that it can treat both the natural and built environment for the purpose of preventing or extinguishing fires. This is one example of a centrifugal pump. Any pump comprising the minimum requirements of a fluid input for concentrate and diluent, a centrifugal pump mechanism and enough pressure and flow rate in the output for delivering the diluted chemical will satisfy the needs of the purpose of the disclosed dispensing equipment.

Table of Figure Elements

| Ref No. | Element | Function |
|---|---|---|
| FIG. 1 | | |
| 1 | Apparatus | Blend and spray chemical |
| 10 | Service water | Add on FIG. 1 |
| 11 | Three-way Conduit | Combine diluent and concentrate |
| 12 | Pump Control(s) | Control(s) for pump rates of both diluent and concentrate pumps |
| 13 | Pump | Concentrate pump provides enough pressure to provide concentrate into three-way conduit against pressure of the diluent |
| 14a | Fluid connection | Direct diluent into the conduit |
| 14b | Fluid connection | Direct concentrate into the conduit |
| 14c | Fluid connection | Direct diluent and concentrate into the pump |
| 15 | Diluent container | Container used if service water not available |
| 16 | Concentrate | Container |
| 17 | Pump | Mixing pump |
| 18 | Conduit Fluid connection | Direct diluent and concentrate into the spray head |

-continued

Table of Figure Elements

| Ref No. | Element | Function |
|---|---|---|
| 19 | Spray Head | Apply direct or spread spray pattern to ignition source |
| 20 | Spray | From head |
| FIG. 10 | | |
| 2 | Apparatus | Blend and dispense chemicals |
| 12 | Pump Control(s) | Control(s) for pump rates of both diluent and concentrate pumps |
| 13 | Pump | Concentrate pump provides enough pressure to provide concentrate into three-way conduit against pressure of the diluent |
| 14a | Fluid connection | Direct diluent into the conduit |
| 14b | Fluid connection | Direct concentrate into the conduit |
| 14c | Fluid connection | Direct diluent and concentrate into the pump |
| 15 | Diluent | Container |
| 16 | Concentrate | Container |
| 20 | Dilute chemical | Container |
| 17 | Pump | Mixing pump |
| 18 | Fluid connection | Direct diluent and concentrate into the spray head |
| 19 | Spray Head | Apply direct or spread spray pattern to ignition source |
| 20 | Container | To dilute and store chemicals |
| 21 | Dilute exit | If pumping not useful |
| 22 | drop | Airborne drop |
| FIG. 11 | | |
| 3 | Pump | Centrifugal |
| 31 | Intake | Diluent Intake |
| 32 | Intake | Input Concentrate |
| 33 | Impeller | Pumps Chemical and Mixes |
| 34 | Pump Housing | Contains Mixing Chamber and Impeller |
| 35 | Outlet | Dilute Chemical |

Figure 2:
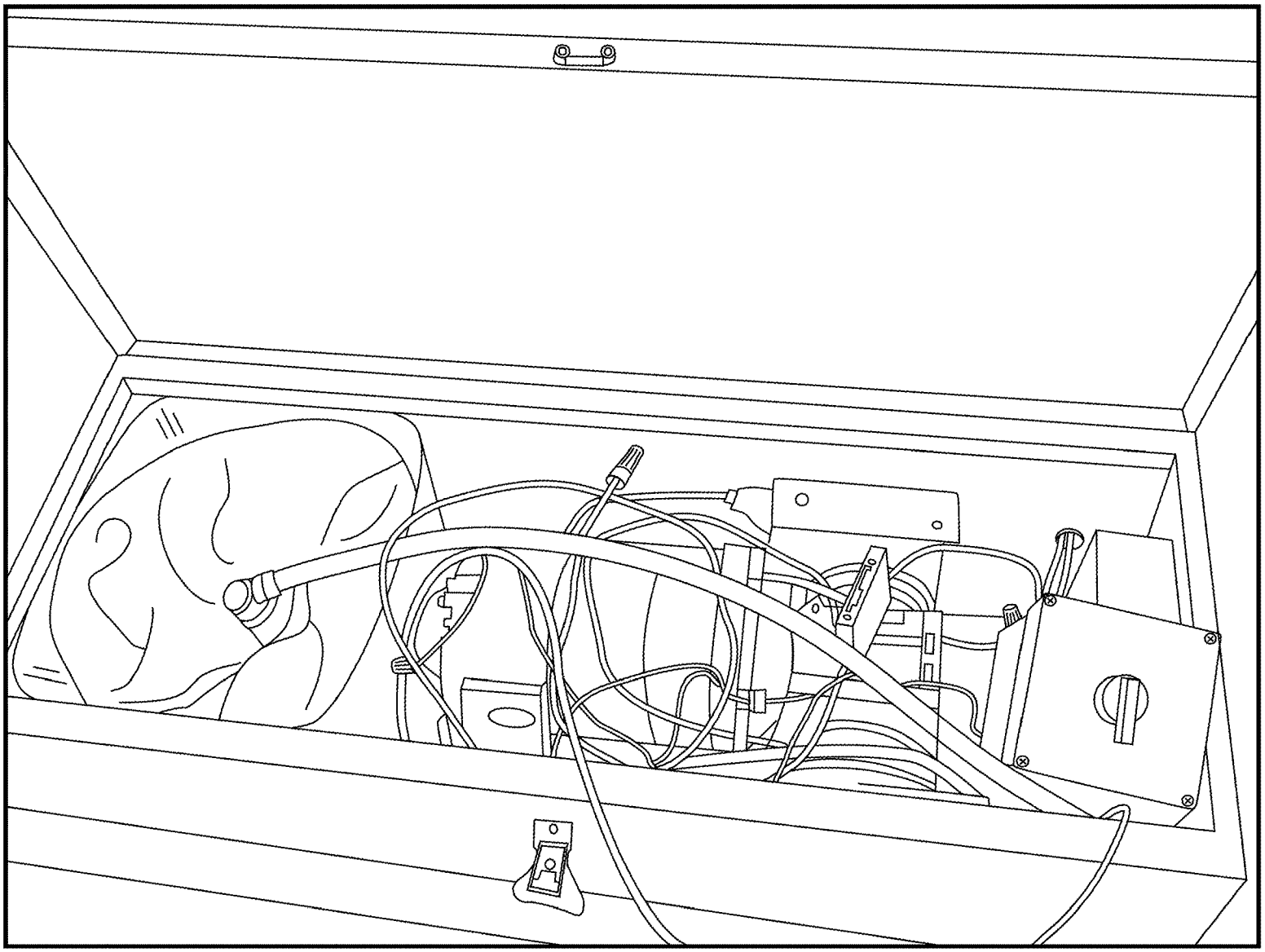
FIGS. 2-9 are photographs of embodiment prototypes of the systems.

FIG. 2 is a photograph of a prototype using (from left to right) bag-in-a-box of the liquid Tetra KO concentrate that is pumped out of the bag via the pump. There is a 12-volt or gasoline motor that has a gear reduction attached to it, which is then connected to the pump. The box (with 1, 2, 3 on it) is the selector that controls the rpm of the pump. Each set revolution rate injects an amount of Tetra KO liquid into the water intake at a set dilution ratio.

Figure 3:
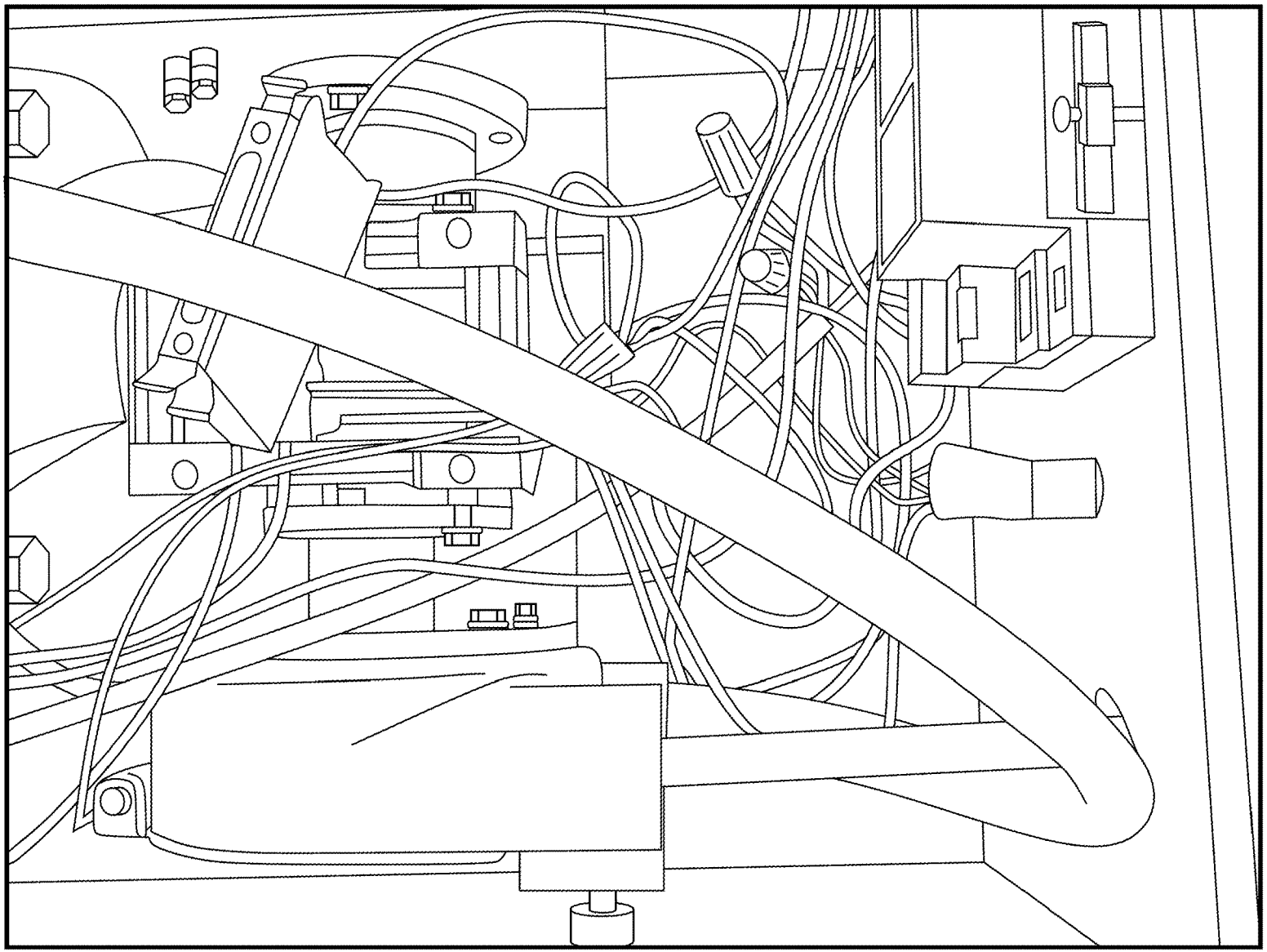
Figure 4:
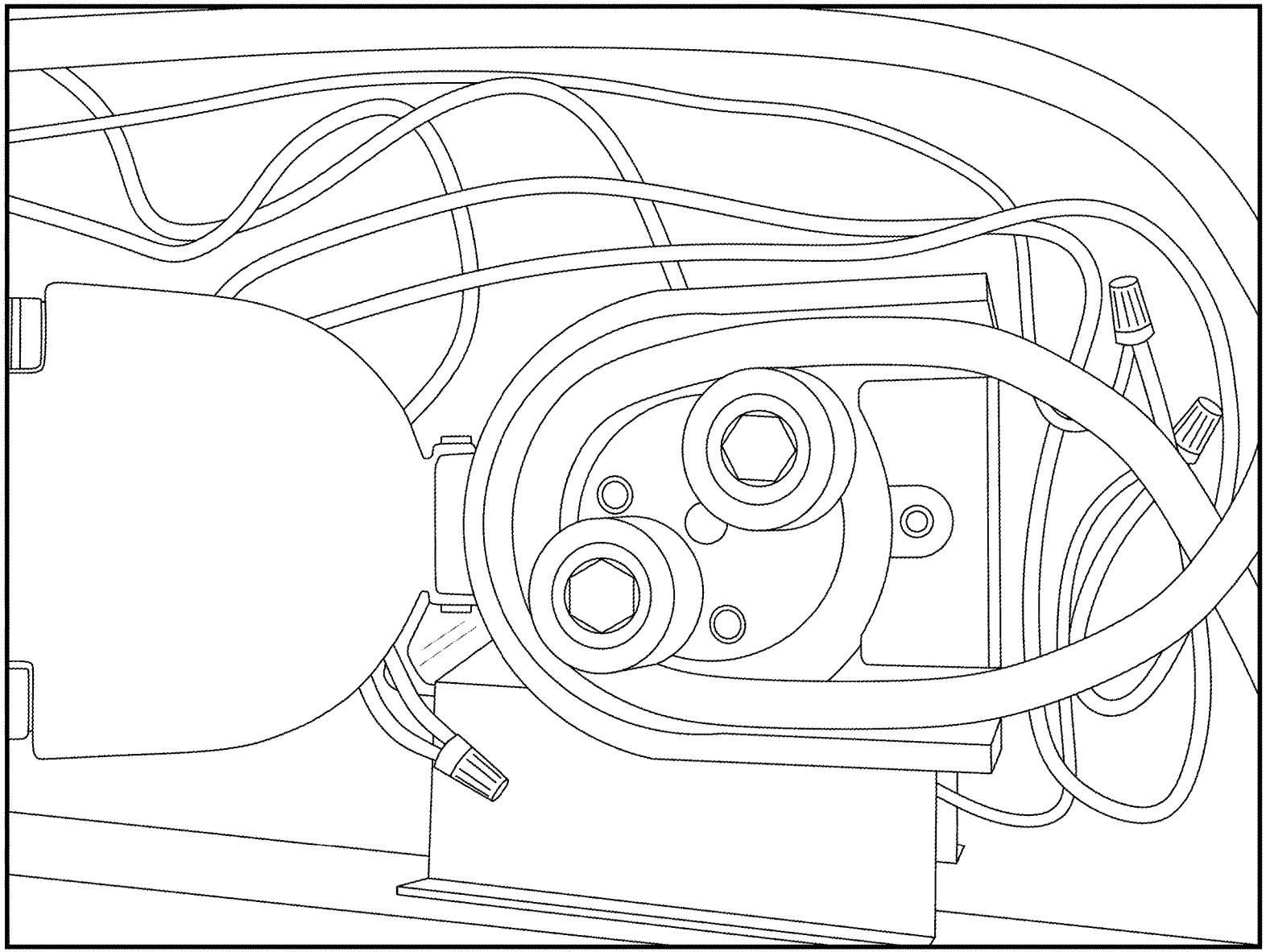

FIGS. 3 and 4 are photographs of the peristaltic pump that rotates and pressure in the tubing propels the concentrate through the hose into the injection point before the pump.

Figure 5:
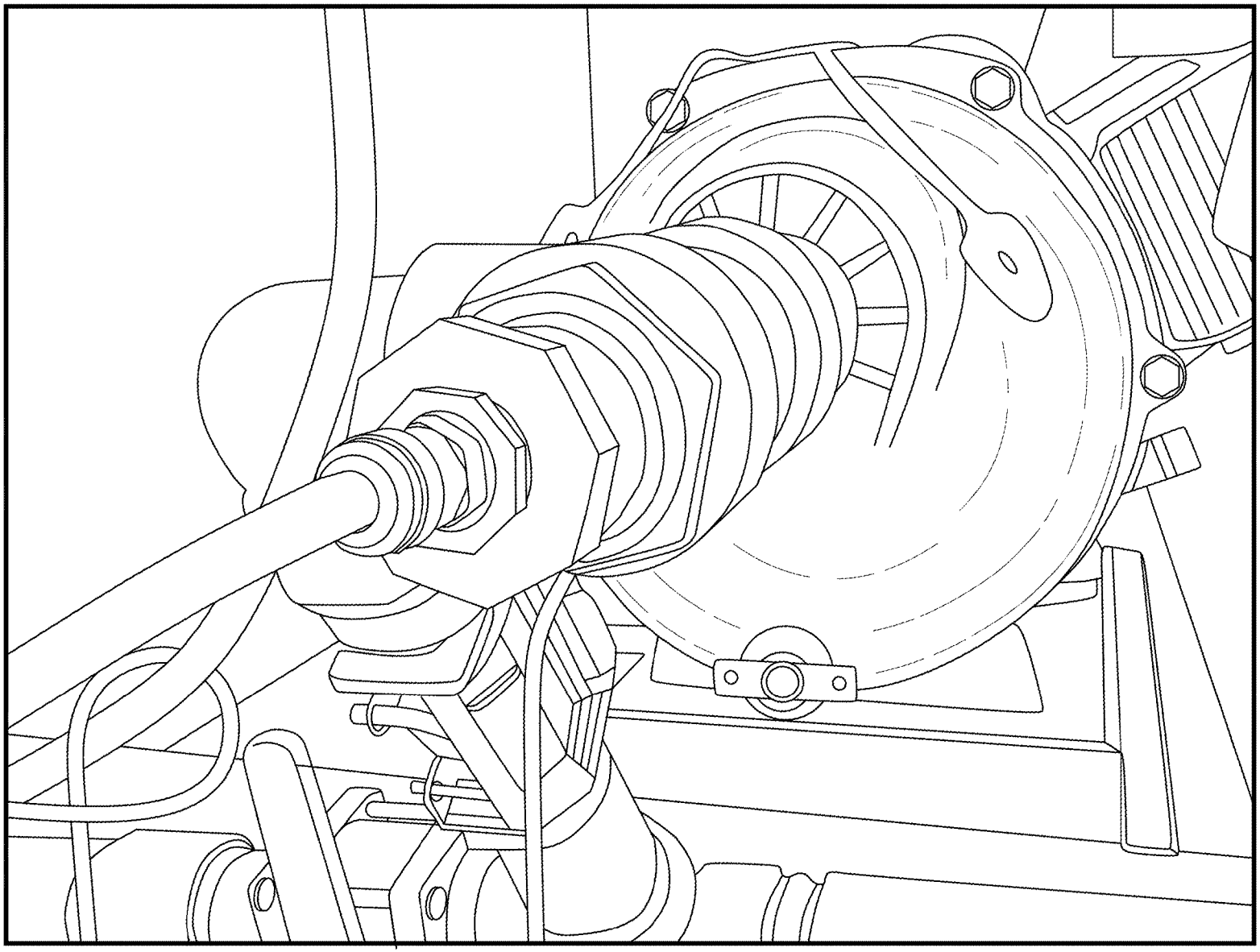
Figure 6:
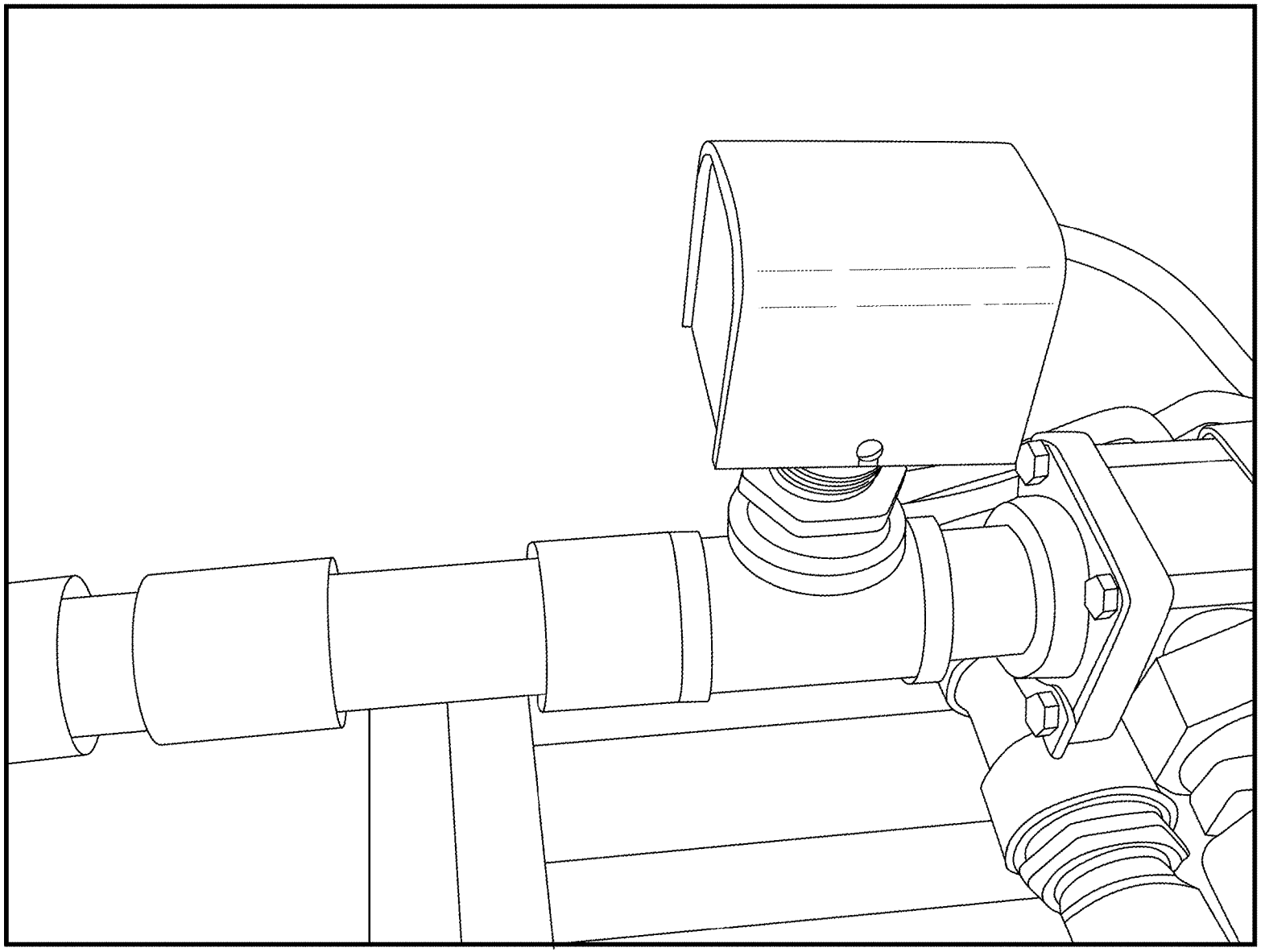

FIG. 5 is a photograph of a prototype with the injection point just before the pump. This hose lays in the water supply just before the pump. The concentrate is mixed by the water pump and proceeds to the dischar6 is a photograph of a prototype water flow switch (black box) that energizes the peristaltic pump when water flows. There is also clear tubing to be able to see if concentrate has mixed. When there is water flowing, it is clear. When concentrate is being injected, it turns an opaque color.

Figure 7:
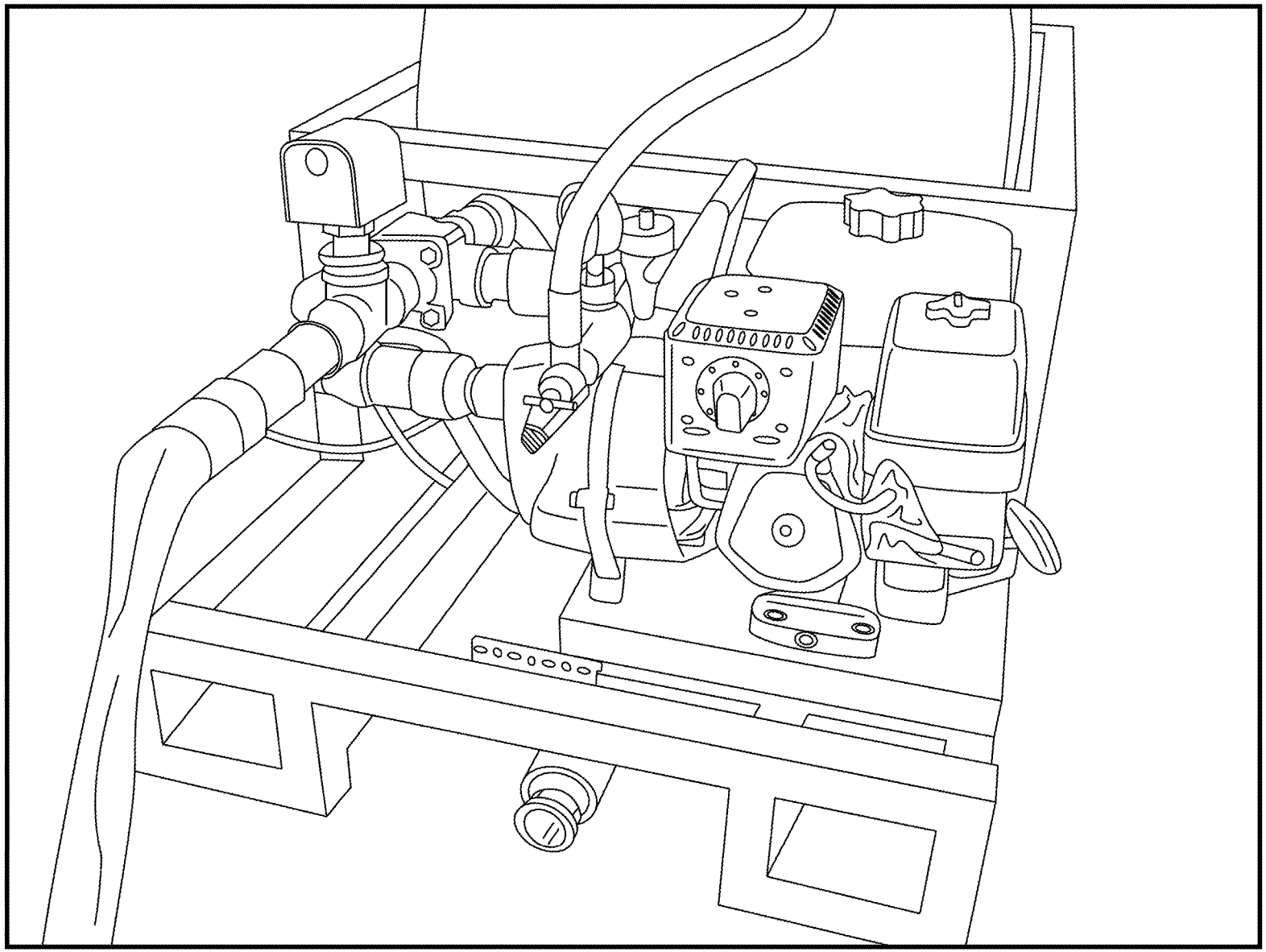

FIG. 7 is a photograph of a prototype system having a source of water, concentrate source and injection, a conduit, gasoline powered pump, a pressure gauge on the pump outlet and a system outlet for dilute chemical.

Figure 8:
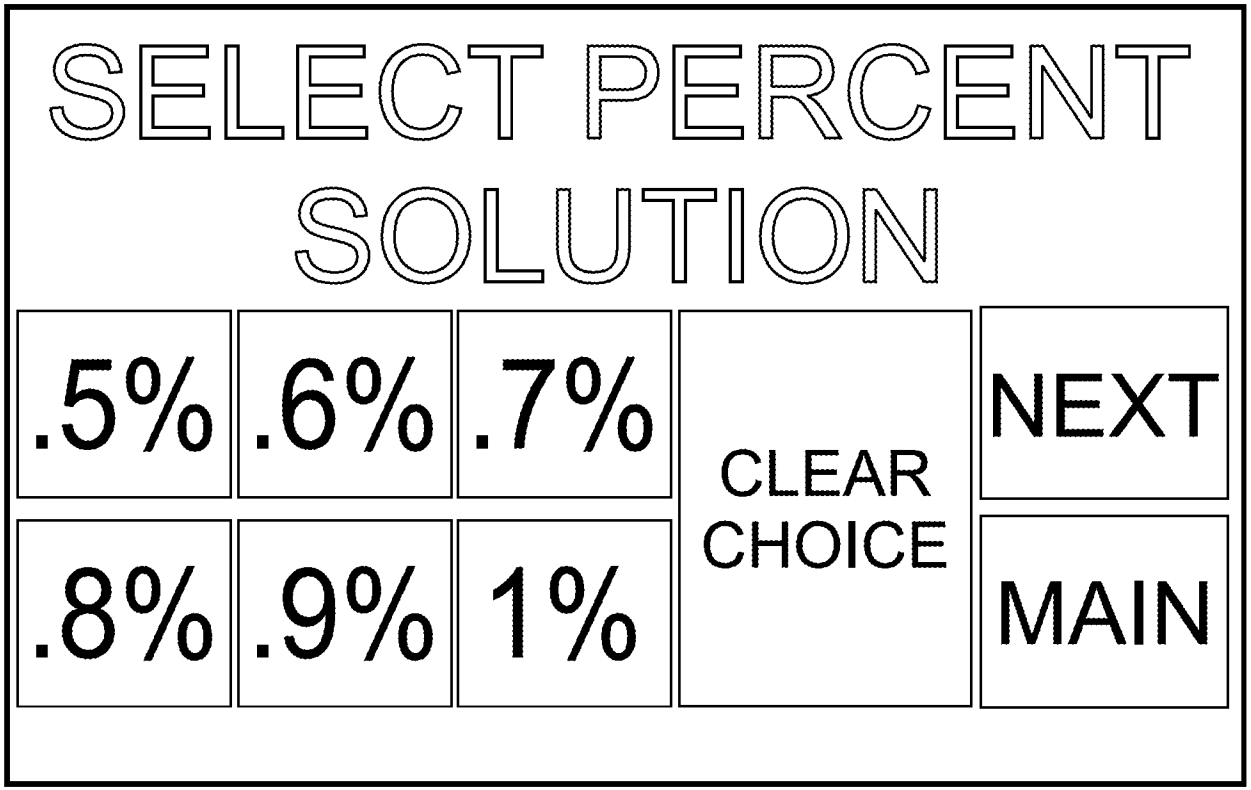
Figure 9:
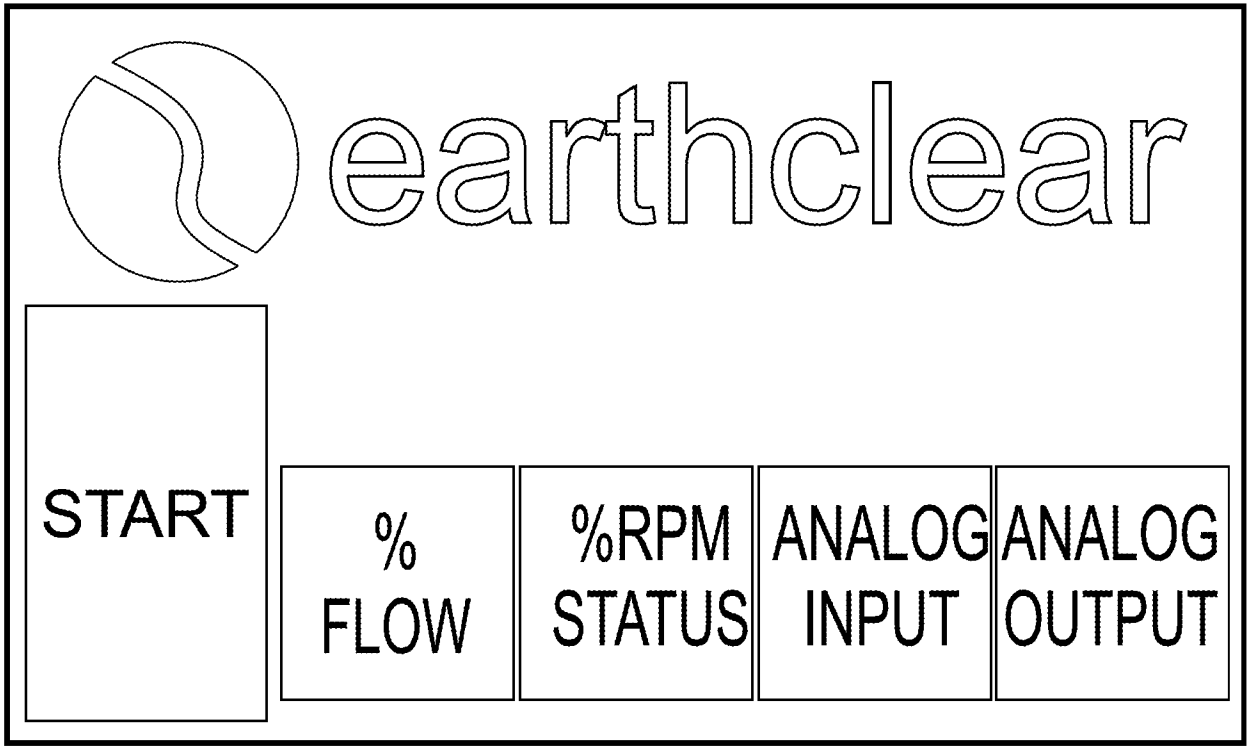

FIGS. 8 and 9 show a computer screen input system for controlling pump rates and dilution ratios or percentages.

The complete disclosure of all patents, patent applications, and publications cited herein are incorporated by reference. If any inconsistency exists between the disclosure and the disclosure(s) of any document incorporated herein by reference, this disclosure shall govern. The foregoing detailed description and examples have been given for clarity of understanding only. No unnecessary limitations are to be understood therefrom. The disclosure is not limited to the exact details shown and described, for variations obvious to one skilled in the art will be included within the disclosure defined by the claims.

Unless otherwise indicated, all numbers expressing quantities of components, molecular weights, and so forth used in the specification and claims are to be understood as being modified in all instances by the term "about." Accordingly, unless otherwise indicated to the contrary, the numerical parameters set forth in the specification and claims are approximations that may vary depending upon the desired properties sought to be obtained. At the very least, and not as an attempt to limit the doctrine of equivalents to the scope of the claims, each numerical parameter should at least be construed considering the number of reported significant digits and by applying ordinary rounding techniques. Notwithstanding that the numerical ranges and parameters setting forth the broad scope of the disclosure are approximations, the numerical values set forth in the specific examples are reported as precisely as possible. All numerical values, however, inherently contain a range necessarily resulting from the standard deviation found in their respective testing measurements. Any headings are for the convenience of the reader and should not be used to limit the meaning of the text that follows the heading, unless so specified.

We claim:

1. An apparatus that dilutes and applies a firefighting chemical to an ignition source, the apparatus comprises:

(i) a three-way conduit with a first input, a second input, and an output;

(ii) a diluent source having an outlet fluidly connected to the first input of the three-way conduit;

(iii) a source of a concentrate fluidly connected to the second input of the three-way conduit; and (iv) a connecting conduit having a first end and a second end, the first end fluidly connected to the output of the three-way conduit;

wherein the second end of the connecting conduit is connected to a first pump that both causes the flow through the three-way conduit and connecting conduit and dispenses a uniform dilute firefighting chemical, the first pump set at a flow rate of $R_1$;

wherein a second pump for the concentrate is set at a second flow rate $R_2$ where $R_2$ is greater than $R_1$, and the $R_1$ and $R_2$ rates are set to deliver a useful dilution of about 0.01 to 5 wt. % of concentrate in the dilution liquid, the diluent comprises service water and the concentrate comprises a non-aqueous liquid comprising starch, a thickener, and a $C_{2-25}$ hydrocarbon, and the diluent and concentrate is mixed in the first pump, and wherein the concentrate comprises at least 20 wt. % of a starch; at least 20 wt. % of a pseudo plastic, sodium polyacrylate suspending agent; vegetable oil and a $C_{6-18}$ olefin; and 0.0 to 5 wt. % clay and the firefighting chemical is a dispersion of 0.01 to 1 wt. % in water.

2. The apparatus of claim 1 wherein the first pump is a centrifugal pump.

3. The apparatus of claim 2 wherein the first pump has a blade impeller.

4. The apparatus of claim 1 wherein the apparatus is free of a venturi.

5. A process for diluting a firefighting chemical for the purpose of delivering the chemical to an ignition source, the process comprises:

(i) directing a flow of a diluent through the first input of a three-way connector, (ii) directing a flow of a concentrate through a second input of a three-way connector, (iii) directing the flow of the diluent and a concentrate from the three-way connector into the inlet of a pump, and (iv) directing the output of the pump comprising the firefighting chemical onto the ignition source; wherein the diluent has a viscosity substantially the same as ground or service water, the concentrate has a viscosity of greater than 1000 to 30000 cP at 25° C.;

wherein the first pump has a rate of about 1 to 2000 gal-min-1 ($R_1$) and the second pump has a rate of 1-2000 gal-min.$^{-1}$($R_2$) wherein R2 is greater than R1; wherein the concentrate comprises at least 20 wt. % of a starch; at least 20 wt. % of a pseudo plastic, sodium polyacrylate suspending agent; vegetable oil, C6-18 olefin; and 0.0 to 5 wt. % clay and the firefighting chemical is a dispersion of 0.01 to 1 wt. % in water and the firefighting chemical is a gel.

6. The process of claim 5 wherein the concentrate comprises at least 50 wt. % of the starch; at least 20 wt. % of the pseudo plastic, sodium polyacrylate suspending agent; vegetable oil and a C6_iS olefin; and 0.0 to 5 wt. % clay and the firefighting chemical is the dispersion of 0.01 to 1 wt. % in water.

7. The process of claim 5 wherein the pump is a centrifugal pump.

8. The process of claim 7 wherein the pump has a blade impeller.

* * * * *